United States Patent [19]

Harding

[11] Patent Number: 4,584,357

[45] Date of Patent: Apr. 22, 1986

[54] LATEX TREATED CATIONIC CELLULOSE PRODUCT AND METHOD FOR ITS PREPARATION

[75] Inventor: Margot J. Harding, Federal Way, Wash.

[73] Assignee: Weyerhaeuser Company, Tacoma, Wash.

[21] Appl. No.: 622,527

[22] Filed: Jun. 20, 1984

[51] Int. Cl.[4] ..... C08L 1/08; D21C 9/00

[52] U.S. Cl. ..... 525/54.21; 162/164.6; 162/164.3

[58] Field of Search ..... 524/35, 27, 13, 14; 525/54.21; 527/300, 312; 162/164.6, 158, 164.3

[56] References Cited

U.S. PATENT DOCUMENTS

| | | | |
|---|---|---|---|
| 3,269,890 | 8/1966 | Gaertner | 162/164.6 |
| 3,902,958 | 9/1975 | Breen et al. | 162/168.5 |
| 3,930,877 | 1/1976 | Aitken | 106/287 |
| 4,125,645 | 11/1978 | Jukes et al. | 427/117 |
| 4,129,528 | 12/1978 | Petrovich et al. | 528/405 |
| 4,178,438 | 12/1979 | Haase et al. | 536/30 |
| 4,256,807 | 3/1981 | Jukes et al. | 428/379 |
| 4,268,352 | 5/1981 | Cosper et al. | 162/191 |
| 4,269,657 | 5/1981 | Gomez et al. | 162/158 |
| 4,505,775 | 3/1985 | Harding et al. | 162/72 |

FOREIGN PATENT DOCUMENTS

| | | | |
|---|---|---|---|
| 2720020 | 11/1977 | Fed. Rep. of Germany | 162/164.6 |
| 85374/74 | 8/1974 | Japan . | |

OTHER PUBLICATIONS

Latimer, J. J., and R. A. Gill, *Tappi* 56 (4): 66–69, (1973).

McKelvey, John B. and Ruth R. Benevito, *Jour. Appl. Polymer Sci.* 11: 1693–1701 (1967).

McKenzie, A. W. *Appita* 21 (4): 104–116, (1968).

Uwatoko, Tsunehiro, *Kagaku Kogyo* 25 (3), 360–362, (1974) (Translation supplied).

*Primary Examiner*—John Kight

*Assistant Examiner*—Nathan M. Nutter

[57] ABSTRACT

The invention is a fibrous cellulosic product, containing a uniformly dispersed polymeric material which has been deposited in an aqueous suspension from an anionic latex, and the method for its manufacture. Cellulosic fiber is first cationized by treating it in an aqueous suspension with the condensation product of epichlorohydrin and dimethylamine. Up to 30% of the dimethylamine may be replaced with a crosslinking agent which can be ammonia or an aliphatic diamine such as hexamethylene diamine. The cationized fiber, with or without small quantities of alum, will effectively retain a wide variety of anionic latices when treated in an aqueous environment.

22 Claims, No Drawings

LATEX TREATED CATIONIC CELLULOSE PRODUCT AND METHOD FOR ITS PREPARATION

BACKGROUND OF THE INVENTION

The present invention is a fibrous cellulosic product containing a uniformly dispersed polymeric material which has been deposited in an aqueous suspension from an anionic latex. The invention further comprises the method of making the products. These products are especially advantageous for making air laid webs wherein the polymer serves as a heat activatable bonding agent.

Treatment of cellulosic products with polymers of various types has a long history in the pulp and papermaking art. Depending on the particular polymeric system being used, and the ultimate effect desired, this treatment may take place either before or after formation of the sheet at the wet end of a paper machine. Often it is desired to retain the polymer on or near the surface or surfaces of the sheet. In this case, it can be applied by any of the conventional coating techniques. For other applications, it is desirable for the polymer to be distributed uniformly throughout the sheet. Where large amounts of polymer are desired, this can be accomplished by dipping or impregnating the sheet after the papermaking process. However, where uniform distribution of smaller amounts of polymer is desired, it is usually preferred to include the additive with the stock prior to the papermaking process. Unfortunately, this is not always possible. Many polymeric materials must be used in the form of aqueous emulsions. These emulsions are usually anionic in nature and, almost universally, will have water as the continuous phase. Within the papermaking industry, these polymer emulsions are typically referred to as "latexes or latices." In the present application the term "latex" refers to very broadly to any anionic aqueous emulsion of a polymeric material. These polymers can range from hard vitreous types to those which are soft and rubbery. They may be either thermoplastic or thermosetting in nature. In the case of thermoplastic polymers they may be materials which remain permanently thermoplastic or they may be types which are partially or fully crosslinkable, with or without an external catalyst, into thermosetting types.

Because of their anionic nature, very few latices can be added directly to a pulp making slurry with the expectation of having satisfactory retention. The cellulosic fibers are also anionic and they will repel the resin particles unless the fiber surface is modified in some means to make it less negative in character. Cationic retention aids are sometimes used to accomplish this purpose. Examples of this practice are found in recent U.S. Pat. Nos. to Jukes, et al., 4,125,645 and 4,256,807. A paper by Latimer and Gill, *Tappi* 56(4): 66–69 (1973), describes the beater deposition of an acrylic latex onto wood pulp using a cationic deposition aid. Another approach outlined in Japanese Kokai 85,374/74 has been to create a cationic latex. However, this approach is possible with only a very limited number of polymeric materials.

The use of cationic retention or deposition aids is not without problems in its own right. Retention aids tend to be quite expensive and any given retention material may be totally ineffective with the latex of choice. Rarely do retention efficiencies exceed 60–70%. For these reasons, it has not been the usual practice to date to employ wet addition of latices except in very selective circumstances.

Another approach has been to precipitate the polymer particles on the fibers by pH change or by chemical additives. This method can cause the latex to agglomerate and form relatively large globules rather than producing a uniform fiber coating.

One problem with the use of retention aids has been the inability of the papermaker to precisely control the electrical charge of the fibers. An approach that has received some study over the years has been to chemically modify the fiber surface to make it less negative. Uwatoko, *Kagaku Kogyo* (Japan) 25(3): 360–362 (1974), briefly summarizes the state of art in regard to cationic fibers and lists six major approaches that have been taken. The first method introduces side chains containing a tertiary nitrogen atom. These side chains are attached to the cellulose molecule at the hydroxyl groups as ethers. One product of this type which has received considerable study is the quaternized diethylaminoethyl derivative of cellulose. A second route to the preparation of cationic cellulose is the reaction of cellulose in the presence of sodium hydroxide with ethanolamine, aqueous ammonia, or melamine. A third process is the reaction between cellulose and a material such as 2-aminoethyl sulfuric acid in the presence of sodium hydroxide. Another product has been formed by iminating an aminated cellulose by reaction between the aminated cellulose and ethylene imine. An approach which has received considerable study is the reaction of various trimethyl ammonium salts. Of particular importance has been glycidyl trimethyl ammonium chloride reacted with cellulose in the presence of a catalytic amount of sodium hydroxide. A related approach has been the reaction of 2-chloroethyldiethyl amine with alkali cellulose. The product is then quaternized with methyl iodide in anhydrous alcohol. Finally, Uwatoko comments on a process where cellulose is reacted with a solution of sodium acid cyanamide at a concentration of 50–200 g/L at a pH in the range of 10–13 and temperature of 10°–40° C. for 4–24 hours.

McKelvey and Benerito, *J. Appl. Polymer Sci.* 11: 1693–1701 (1967), show the reaction of cellulose with a mixture of epichlorohydrin and a tertiary amine in the presence of aqueous sodium hydroxide.

The references cited are exemplary only since the preparation of cationic cellulose is not the subject of the present invention. The reader interested in a more detailed literature survey of cationic celluloses might refer to the present assignee's copending application, Ser. No. 507,366, filed June 24, 1983 now U.S. Pat. No. 4,505,775. This application, of which the present inventor is a coinventor, describes a very inexpensive and greatly simplified process for manufacturing a cationic cellulose. This is done by adding either a linear or partially crosslinked water soluble reaction product of epichlorohydrin and dimethylamine to an aqueous suspension of cellulose under alkaline conditions. The preferred concentrations of epichlorohydrin and dimethylamine will be approximately equimolar in proportion. Ammonia and primary aliphatic diamines serve to act as crosslinking agents for the reaction products. Further, their use increases the number of tertiary nitrogen atoms which may be quaternized to provide sites for positive charges. Up to 30 molar percent of the dimethylamine may be replaced by ammonia or the aliphatic diamine in the condensation process. In general, it is preferred that the molar percentage of the crosslinking material should be in the range of 10–20%. Preparation of suitable reaction products is described in U.S. Pat. No. 3,930,877 to Aitken.

It has been found that a cationic cellulose of the types described in the foregoing patent application can effectively bond a wide variety of anionic latices under the processing conditions normally used prior to the wet end of a paper machine. The products thus prepared have a wide variety of uses, particularly in areas where the fibers are later formed into air laid webs of various types.

SUMMARY OF THE INVENTION

The present invention comprises a new composition of matter and the method for making it. In its broadest form, the composition comprises a cationized cellulose and from 0.1–30%, on a dry weight basis, of a polymer capable of being emulsified into an anionic dispersion. The cationized cellulose is an additive of cellulose with a material from the group consisting of a reaction product of epichlorohydrin and dimethylamine, said reaction product further modified by a crosslinking agent, and mixtures thereof wherein the cross linking agent, if present, is selected from the group consisting of ammonia and a primary aliphatic diamine of the type $H_2N$—R—$NH_2$ wherein R is an alkylene radical of from 2–8 carbon atoms.

The product is made by first preparing the cationic cellulose by treating cellulose under aqueous alkaline conditions with a material selected from the aforementioned group of reaction products. The cationized cellulose is then treated in an aqueous suspension with an anionic polymer emulsion within the range of usage noted above. The cationic cellulose may be prepared aforehand and conventionally dried, as by sheeting, or it can be prepared, washed, and immediately treated with the appropriate latex. The term "latex" is considered in its broadest sense as being any aqueous based anionic polymer emulsion in which water is the continuous phase.

A preferred cationic additive is made using an approximately equimolar reaction product of epichlorhydrin and dimethylamine in which up to 30 molar percent of the diethylamine has been replaced by hexamethylene diamine. The cationizing reaction product will normally be used in the range of 0.5–20 kg/t based on the dry weight of the cellulose. More typically it will be used within the range of 1–10 kg/t.

A wide range of polymer emulsions or latices can be successfully bonded to the cationic cellulose. These can be polymers based on acrylonitrile, styrene-butadiene, styrene-acrylonitrile, acrylonitrile-butadiene-styrene, acrylic and methacrylic ethers, vinylacrylics, vinylacetate, vinylchloride, and polyolefins such as polyethylene, polypropylene, and various polymers based on polybutene. Mixtures of two or more types of these polymers are considered to be within the scope of the invention as are block and graft copolymers of two or more of the monomeric species just noted. The above list should be considered as exemplary rather than limiting.

Among the preferred polymers are the various types broadly identified as polyvinyl acetate and polyacrylates and methacrylates. Polyvinyl acetates are generally partially hydrolyzed materials and may be chemically modified so they can be crosslinked by applying heat, with or without the need for an external catalyst. The polyacrylate and methacrylate resins likewise are considered in a generic sense since there are many versions which may be either permanently thermoplastic or which can be crosslinked with or without the need for an external catalyst. The resin treated products of the invention may be prepared in sheeted form, as loose fibrous materials, or in other of the forms well known in the papermaking industry. The products are particularly useful for making such absorbent materials as air laid paper towelling or industrial wipes. These products are currently made by spraying on as much as 30% latex binder after formation of an air laid felt. The large amount of water added at this time necessitates an additional drying step which is not required using the products of the present invention.

It is an object of the present invention to provide a fibrous, polymer-treated cellulosic product in which the polymer is uniformly distributed over the fiber surface.

It is another object to provide a simple method for adding a polymeric latex to cellulosic fibers.

It is a further object to provide a method for treating cellulosic fibers in aqueous suspension with an anionic polymer latex without the necessity for using a cationic retention or deposition aid.

These and many other objects will become immediately apparent to those skilled in the art upon reading the following detailed description.

DETAILED DESCRIPTION OF THE PREFERRED EMBODIMENTS

The products of the present invention are made by first preparing a cationic cellulose. This is made by treating a dilute aqueous suspension of the cellulose with a reaction product of epichlorohydrin and dimethylamine (Epi-DMA) or a reaction product of these materials which has been modified by a crosslinking agent which may be ammonia or a primary aliphatic diamine of the type $H_2N$—R—$NH_2$ wherein R is an alkylene radical of from 2–8 carbon atoms. This treatment may be carried out at the end of a bleaching sequence. Alternatively, it can be carried out during any alkaline bleaching step at which the pH is 10 or above, as long as this step is not followed by a chlorination or hypochlorite stage. The temperature and time for the preparation of the cationic cellulose are not critical. The addition and/or reaction product between cellulose and the Epi-DMA condensate appears to form very rapidly. The cationized cellulose product may then be dried by conventional sheeting, as loose fiber, or in other physical forms. It may be also used without further drying wherein it is suspended in water and the appropriate latex simply added with gentle agitation.

The following examples will serve to show specific embodiments of the present invention.

EXAMPLE 1

Bleached Douglas-fir kraft pulp was obtained from a northwestern pulp mill. Samples having 15.5 g of dry fiber were slurried in 760 mL of water to produce a suspension having 2% consistency. The pH was adjusted to 10.5 with NaOH and 0.16 g of a 50% aqueous solution (5 kg/t on an active material basis) of an epichlorohydrin-dimethylamine reaction product partially crosslinked with hexamethylene diamine was added with stirring. The reaction product is available as Nalco N-7135 from Nalco Chemical Co., Oak Brook, Ill. After gentle agitation for 30 minutes the pulp was drained on a Buchner funnel and washed until the washings were essentially neutral. This cationic product was stored for further use without drying. Kjeldahl nitrogen determinations made on the treated product showed a retention efficiency for the additive in the range of 85–90%. The procedure was readily scaled up for preparation of larger quantities of cationic fiber without any loss of retention efficiency.

EXAMPLE 2

Cationic fiber prepared as in Example 1 was reslurried in water to give a suspension at 2% consistency. Using continuous gentle agitation, varying amounts of a crosslinkable polyvinyl acetate emulsion having 50% solids content were added. Samples were made using 5, 10, and 30% emulsion solids based on cationized fiber. One suitable emulsion is available as Airflex 105 from Air Products and Chemicals, Inc., Allentown, Pa. Agitation was continued for 30 seconds after completion of latex addition. Additional dilution water was added and the fiber suspension was formed into hand sheets in a standard 8×8 inch (20.3×20.3 cm) Noble and Wood laboratory sheet former. The sheets were drum dried to about 80% moisture and then conditioned. Standard Mullen burst tests were run on the sheets after air drying and before further processing.

After checking burst values, the sheets were refiberized dry in a high shear blender and air felted into sheets 6 inches (15.9 cm) in diameter with a basis weight averaging 50 g/m$^2$. The air formed felts were pressed for 15 seconds at 150° C. and 300 psi (2,068 kPa) to consolidate them into handleable tissue sheets.

An additional sample was made using 10% of the polyvinyl acetate latex. After the dry felted sheets were formed, but before pressing, one sample set was sprayed with a water solution containing 0.74%, based on latex solids, of citric acid. Citric acid serves as a catalyst to induce crosslinking of the polymer.

Dry tensile strength values were determined for the tissues using a constant rate of elongation tester having a head speed of 2 in./min. with a 3 in. span between clamps and 1 in. wide samples. Test results are shown in the following table.

TABLE I

| Resin Usage, % | Handsheet Mullen, kPa | Tissue Tensile, N/m |
|---|---|---|
| 0 | 900–1100 | 6–10 |
| 5 | 1120 | 18 |
| 10 | 1500 | 45 |
| 10 + catalyst | 1530 | 88 |
| 30 | 1180 | 30 |

The dramatic improvement in dry laid tissue tensile strength using up to 10% latex is immediately apparent.

EXAMPLE 3

Products made according to the present invention have potential applications in many areas. Among these are uses where strength must be combined with softness to the touch. Paper toweling and facial tissues are examples as are wrapper tissues for diaper and sanitary napkin fillers. In many of these uses rapid water absorption is also important.

Latex treated samples were made as in Example 2, using 10% latex solids based on cationized pulp. In addition to the polyvinyl acetate latex used previously, a sample set was made using Airflex 4500 polyvinyl chloride crosslinking latex. This is available from the supplier noted previously.

One sample with each latex was further treated with a surfactant to promote rapid wetting. This was added as an aqueous solution at the time of latex addition to the cationized pulp slurry, using 0.74% based on latex solids. Many types of surfactants are suitable. The specific material used for the products in this example was Aerosol OT, a dioctyl ester of sodium sulfo-succinic acid, available from American Cyanamid Co., Wayne, N.J.

The products were made into dry laid sheets as before with the exception that basis weight was increased to an average of 200 g/m$^2$ to simulate paper toweling. On selected samples a citric acid catalyst solution was sprayed on the air felted fiber, as described in Example 2, to promote crosslinking of the resin. An amount equivalent to 0.74% based on latex solids was used.

Wet and dry tensile strengths were determined as was the time to completely wet out a 5.1×5.1 cm sample free floating on a water surface. In order to avoid handling damage to strips intended for wet tensile tests, the strips were placed dry in the jaws of the tester and then water sprayed until thoroughly wet. Results of the tests follow.

TABLE II

| Resin Emulsion | Wetting Agent Present | Tensile Strength, N/m Dry | Tensile Strength, N/m Wet | Wetting Time, sec. |
|---|---|---|---|---|
| PVAc A-105[1] | No | — | — | 52 |
| PVAc + Catalyst | No | 251 | 38.7 | 34 |
| PVAc + Catalyst | Yes | 283 | 39.3 | 1.6 |
| PVC A-4500[2] | No | — | — | 8.2 |
| PVC + Catalyst | No | 112 | 36.3 | 3.2 |
| PVC + Catalyst | Yes | 81 | 32.0 | 1.4 |
| None | No | 6–10 | — | 0.5–1.0 |

[1]Polyvinyl acetate
[2]Polyvinyl chloride

The effectiveness of the surfactant in reducing wetting time is immediately apparent. This may in part be due to the cationic nature of the fiber which serves to retain the anionic surfactant.

After the above laboratory tests had been complete, trials were made on a continuous pilot scale paper machine using cationized fiber as the cellulosic furnish. In the first trial, the resin emulsion was added to the fiber at the machine chest. This is an area of vigorous agitation which caused foaming, resulting in numerous sheet breaks. In a later trial, the latex was added just prior to the headbox. Running conditions on the paper machine and product quality were excellent.

The optimum point for adding the surfactant in a paper machine run has not yet been determined. Adding the surfactant following latex addition and immediately prior to the machine headbox failed to achieve results equal to those reached in laboratory trials.

A set of samples similar to those described earlier in the example was made using uncationized fiber. Latex usage was 10% solids based on dry fiber. On some samples 10 kg/t of alum was used at the time of latex addition.

TABLE III

| Resin Emulsion | Catalyst Present | Alum Present | Dry Tensile Strength, N/m |
|---|---|---|---|
| PVAc A-105 | No | No | 37 |
| PVAc A-105 | No | Yes | 83 |

TABLE III-continued

| Resin Emulsion | Catalyst Present | Alum Present | Dry Tensile Strength, N/m |
|---|---|---|---|
| PVAc A-105 | Yes | No | 50 |
| PVAc A-180 | No | No | 52 |
| PVAc A-180 | No | Yes | 111 |
| PVAc A-180 | Yes | No | 50 |
| PVC A-4500 | No | No | 56 |
| PVC A-4500 | No | Yes | 144 |

The tensile strength superiority of the samples made with cationized fiber is immediately evident with the exception of the one sample made with PVC and alum.

EXAMPLE 4

The cationized fiber of Example 1 is effective in retaining a wide variety of anionic polymer dispersions (latices) having significantly differing chemical properties. As might be expected, this array of latices produces ultimate products which may differ significantly in physical and chemical properties. However, most of the resin systems tested produced a very significant increase in the tensile strength of a dry felted tissue product, made as described in Example 2. Tests were made with the following polymer emulsions: Airflex 105 and 120 (polyvinyl acetate), Airflex 4500 (polyvinyl chloride, all available from Air Products and Chemicals Co., Allentown, Pa.; Hycar 2671 and 26170 (acrylic) and Hycar 1572 and 1572X64 (acrylonitrile), all products of B. F. Goodrich Company, Cleveland, Ohio; and Surlyn 56220 (polyethylene) available from E. I. duPont de Nemours & Co., Wilmington, Del. Each was added as described in Example 2 using 10% polymer solids based on cationized fiber. The following tensile tests were run on air laid tissues having a 50 g/m$^2$ basis weight. No catalyst was used for any samples.

TABLE IV

| Polymer Emulsion | Resin Type | Tensile Strength N/m |
|---|---|---|
| Airflex 105 | Polyvinyl acetate | 45 |
| Airflex 120 | Polyvinyl acetate | 19 |
| Airflex 4500 | Polyvinyl chloride | 45 |
| Hycar 4671 | Acrylic | 38 |
| Hycar 26170 | Acrylic | 26 |
| Hycar 1572 | Acrylonitrile | 22 |
| Hycar 1572X64 | Acrylonitrile | 20 |
| Surlyn 56220 | Polyethylene | 10 |
| None | | 6–10 |

The improvement in tensile strengths over an untreated control is immediately apparent.

The above tests are not shown as a comparison of the relative merits of the products tested. Many properties besides dry tensile strength are important and these will vary greatly between different resin types. Further, it is unlikely that all, or even any, were used under optimum conditions. Nor are the tests to be regarded as any endorsement of the products of the above manufactures since many competing products are considered to work equally well. The purpose of the tests was solely to show the effectiveness of the cationized fiber at retaining various generic types of latices without the need for external retention aids.

Analytical methods are not available for precise determination of the amounts of different types of latices retained by cationized fiber. By using a saponification method, it is estimated that about 82% of the A-105 polyvinyl acetate is retained. Other test methods indicate retention of various latex types in the range of 60 to 90+%. The use of small quantities of alum; e.g., 2.5–10 kg/t with the cationized fiber can improve retention of some types of latex as is shown in the following examples.

EXAMPLE 5

A cationic cellulose is made as in Example 1 except that an uncrosslinked epichlorohydrin-dimethylamine reaction product (Nalco N-7655) (Epi-DMA) was used in place of the hexamethylene diamine (HMDA) modified material of the previous example. Usage in the present case was higher, 10 kg/t, in contrast to 5 kg/t for the earlier material. Retention efficiency of the reaction product was measured by Kjeldahl nitrogen determination as about 87%.

EXAMPLE 6

The cationized fibers of Examples 1 and 5 were slurried in water and varying amounts of a self-crosslinking acrylic emulsion latex (UCAR 872, Union Carbide Corp., New York, N.Y.) were added. Handsheets were then made from the fiber latex mixtures. In addition to the two treated materials, trials were run on untreated pulp and untreated pulp with alum in ranges from 2.5 to 5 kg/t alum.

Untreated fiber, untreated fiber with alum and the fiber treated with 10 kg/t Epi-DMA were ineffective at retaining this latex, which was essentially all lost with the white water. Fiber treated with HMDA modified condensate showed excellent latex retention, as measured by increase in sheet weight.

When small amounts of alum were added to the mixture of Epi-DMA treated fiber and latex, the latex was effectively retained at alum usages of 5 kg/t and greater. Alum at usages of about 2.5 kg/t also improved latex retention of fiber treated with HMDA modified polymer although not to the same extent as with the Epi-DMA treated fiber. With the HMDA modified sample, there did not appear to be significant advantage in using alum in amounts greater than 2.5 kg/t.

It is apparent that the particular cationizing agent used will affect the final fiber properties. Some agents will be optimum for certain latices but will be less effective with others. There does not appear to be any way to predict this relationship and it must, to a large degree, be determined experimentally.

It will be evident to those skilled in the art that many variations can be made without departing from the spirit of the present invention. The invention is to be considered as limited only by the following claims.

I claim:

1. A cellulose based product which comprises:

a. a fibrous cationic cellulose prepared by the treatment under aqueous alkaline conditions of cellulose with a material from the group consisting of a reaction product of epichlorohydrin and dimethylamine, said reaction product further modified with a crosslinking agent, and mixtures thereof wherein the crosslinking agent, if present, is selected from the group consisting of ammonia and a primary aliphatic diamine of the type $H_2N—R—NH_2$ where R is an alkylene radical of from 2 to 8 carbon atoms; and b. from 0.1 to 30%, on a dry weight basis, of a polymeric capable of being emulsified into an anionic dispersion, said polymer being uniformly dispersed on the fibrous cellulose.

2. The product of claim 1 in which the reaction product of epichlorohydrin and dimethylamine is prepared using essentially equimolar portions of the reactants.

3. The product of claim 2 in which up to 30 molar percent of the dimethylamine is replaced by hexamethylene diamine.

4. The product of claim 2 in which up to 30 molar percent of the dimethylamine is replaced by ammonia.

5. The product of claim 2 in which up to 30 molar percent of the dimethylamine is replaced by ethylene diamine.

6. The product of claim 1 in which the epichlorohydrin-dimethylamine reaction product is used in an amount in the range of 0.5–20 kg/t based on the dry weight of cellulose.

7. The product of claim 6 in which the epichlorohydrin-dimethylamine reaction product is used in an amount in the range of 1–10 kg/t based on the dry weight of cellulose.

8. The product of claim 1 in which the polymer is selected from the group of crosslinking and noncrosslinking types of polyvinyl chloride, polyvinyl acetate, acrylonitrile, polystyrene, styrene-butadiene, styrene-acrylonitrile, acrylonitrile-butadiene-styrene, acrylic, vinyl acrylic resins, and polyolefins, mixtures thereof, and block and graft copolymers thereof.

9. The product of claim 8 in which the polymer is selected from the group of crosslinking and noncrosslinking types of polyvinyl acetate and acrylic resins, mixtures thereof, and block and graft copolymers thereof.

10. The product of claim 3 in which the polymer is selected from the group of crosslinking and noncrosslinking types of polyvinyl chloride, polyvinyl acetate, acrylonitrile, polystyrene, styrene-butadiene, styrene-acrylonitrile, acrylonitrile-butadiene-styrene, acrylic, vinyl acrylic resins, and polyolefins, mixtures thereof, and block and graft copolymers thereof.

11. The product of claim 10 in which the polymer is selected from the group of crosslinking and noncrosslinking types of polyvinyl acetate and acrylic resins, mixtures thereof, and block and graft copolymers thereof.

12. A method for preparing a cellulose based product which comprises a. preparing a cationic cellulose by treating cellulose under aqueous alkaline conditions with a material from the group consisting of the reaction product of epichlorohydrin and dimethylamine, said condensate further modified by a crosslinking agent, and mixtures thereof wherein the crosslinking agent, if present, is selected from the group consisting of ammonia and a primary aliphatic diamine of the type $H_2N—R—NH_2$ wherein R is an alkylene radical of from 2 to 8 carbon atoms; and b. further treating the cationized cellulose while in an aqueous suspension with an anionic polymer emulsion in an amount of from 0.1 to 30%, on a dry weight basis, whereby the polymer is uniformly deposited on the cellulose.

13. The method of claim 12 in which the cellulose is treated with the reaction product of essentially equimolar portions of epichlorohydrin and dimethylamine.

14. The method of claim 13 in which up to 30 molar percent of the dimethylamine is replaced by ammonia.

15. The method of claim 13 in which up to 30 molar percent of the dimethylamine is replaced by ethylene diamine.

16. The method of claim 13 in which up to 30 molar percent of the dimethylamine is replaced by hexamethylene diamine.

17. The method of claim 12 further comprising using the epichlorohydrin-dimethylamine reaction product in an amount of 0.5–30 kg/t based on the dry weight of cellulose.

18. The method of claim 17 further comprising using the epichlorohydrin-dimethylamine reaction product in an amount of 1–10 kg/t based on the dry weight of cellulose.

19. The method of claim 12 in which the polymer emulsion is selected from the group of crosslinking and noncrosslinking types of polyvinyl chloride, polyvinyl acetate, acrylonitrile, polystyrene, styrene butadiene, styrene-acrylonitrile, acrylonitrile-butadiene-syrene, acrylic, vinyl acrylic resins, and polyolefins, mixtures thereof, and block and graft copolymers thereof.

20. The method of claim 19 in which the polymer is selected from the group of crosslinking and noncrosslinking types of polyvinyl acetate and acrylic resins, mixtures thereof, and block and graft copolymers thereof.

21. The method of claim 16 in which the polymer is selected from the group of crosslinking and noncrosslinking types of polyvinyl chloride, polyvinyl acetate, acrylonitrile, polystyrene, styrene butadiene, styrene-acrylonitrile, acrylonitrile-butadiene-styrene, acrylic, vinyl acrylic resins, polyolefins, mixtures thereof, and block and graft copolymers thereof.

22. The method of claim 21 in which the polymer is selected from the group of crosslinking and noncrosslinking types of polyvinyl acetate and acrylic resins, mixtures thereof, and block and graft copolymers thereof.

* * * * *